US010640189B2

(12) United States Patent
Hasegawa

(10) Patent No.: US 10,640,189 B2
(45) Date of Patent: May 5, 2020

(54) OUTBOARD MOTOR

(71) Applicant: YAMAHA HATSUDOKI KABUSHIKI KAISHA, Iwata-shi, Shizuoka (JP)

(72) Inventor: Hiroyuki Hasegawa, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/897,222

(22) Filed: Feb. 15, 2018

(65) Prior Publication Data

US 2019/0002071 A1 Jan. 3, 2019

(30) Foreign Application Priority Data

Jun. 30, 2017 (JP) ..... 2017-129327

(51) Int. Cl.
*B63H 20/32* (2006.01)
*B63H 20/24* (2006.01)

(52) U.S. Cl.
CPC ..... *B63H 20/245* (2013.01); *B63H 20/32* (2013.01); *B63B 2758/00* (2013.01); *B63B 2770/00* (2013.01)

(58) Field of Classification Search
CPC ..... B63H 20/32; B63H 20/245
See application file for complete search history.

(56) References Cited

U.S. PATENT DOCUMENTS

2013/0019820 A1* 1/2013 Inaba ..... B63H 20/32 123/41.54

FOREIGN PATENT DOCUMENTS

JP 2013-023114 A 2/2013
JP 2015-000678 A 1/2015

* cited by examiner

*Primary Examiner* — Andrew Polay
(74) *Attorney, Agent, or Firm* — Keating and Bennett, LLP

(57) ABSTRACT

An outboard motor includes an engine, a fan driven by the engine to discharge air surrounding the engine, and a cowl housing the engine and the fan. The cowl includes a top cowl that is disposed above the engine and includes an exhaust pathway for exhaust to flow from the fan, and an exhaust port connected to the exhaust pathway and located on the top cowl. The exhaust port opens in a forward direction of the outboard motor.

12 Claims, 9 Drawing Sheets

OUTBOARD MOTOR

CROSS REFERENCE TO RELATED APPLICATIONS

This application claims the benefit of priority to Japanese Patent Application No. 2017-129327 filed on Jun. 30, 2017. The entire contents of this application are hereby incorporated herein by reference.

BACKGROUND OF THE INVENTION

1. Field of the Invention

The present invention relates to an outboard motor including an air intake pathway to lead outside air to an engine, and to a watercraft including the outboard motor.

2. Description of the Related Art

There has been conventionally known a type of outboard motor in which an exhaust port, facing sideward, is provided on the lateral surface of a top cowl located on the top of a cowl (see Japan Laid-open Patent Application Publication No. 2015-000678), and another type of outboard motor in which an exhaust port, facing upward, is provided on the upper surface of a top cowl (see Japan Laid-open Patent Application Publication No. 2013-023114).

Each of the exhaust ports is provided to discharge air surrounding an engine.

However, there is a drawback that during navigation of the watercraft, water is likely to intrude into the outboard motor through the exhaust port that faces sideward and is provided on the lateral surface of the top cowl.

Likewise, there is a drawback that during navigation of the watercraft, water is likely to intrude into the outboard motor through the exhaust port that faces upward and is provided on the upper surface of the top cowl.

SUMMARY OF THE INVENTION

Preferred embodiments of the present invention provide an outboard motor that prevents water from intruding therein through an exhaust port.

An outboard motor according to a preferred embodiment of the present invention includes an engine, a fan driven by the engine to discharge air surrounding the engine, and a cowl housing the engine and the fan. The cowl includes a top cowl that is disposed above the engine and includes an exhaust pathway for exhaust to flow from the fan, and an exhaust port connected to the exhaust pathway and is provided on the top cowl. The exhaust port opens in a forward direction of the outboard motor.

According to preferred embodiments of the present invention, it is possible to provide an outboard motor that prevents water from intruding therein through an exhaust port.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

An outboard motor according to preferred embodiments of the present invention will be hereinafter explained with reference to the drawings. In the present specification, a side of the outboard motor directed toward a vessel body will be referred to as the "front", whereas a side of the outboard motor directed away from the vessel body will be referred to as the "rear". In the present specification, the terms "up" and "down" are defined with reference to a vertical direction, whereas the terms "right" and "left" are defined with reference to a traveling direction during forward movement of the vessel body.

Figure 1:
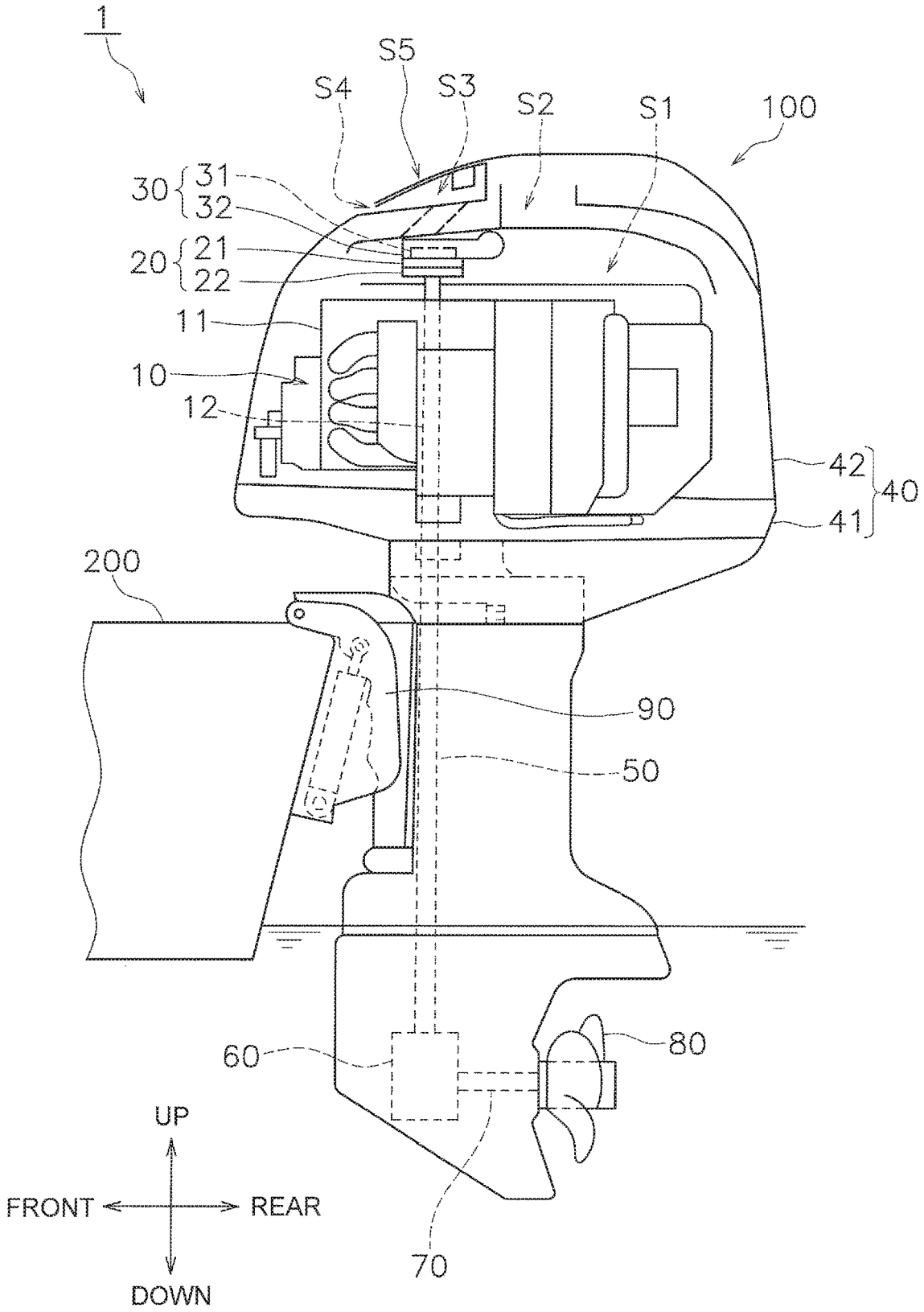
FIG. 1 is a side view of a watercraft.
Figure 2:
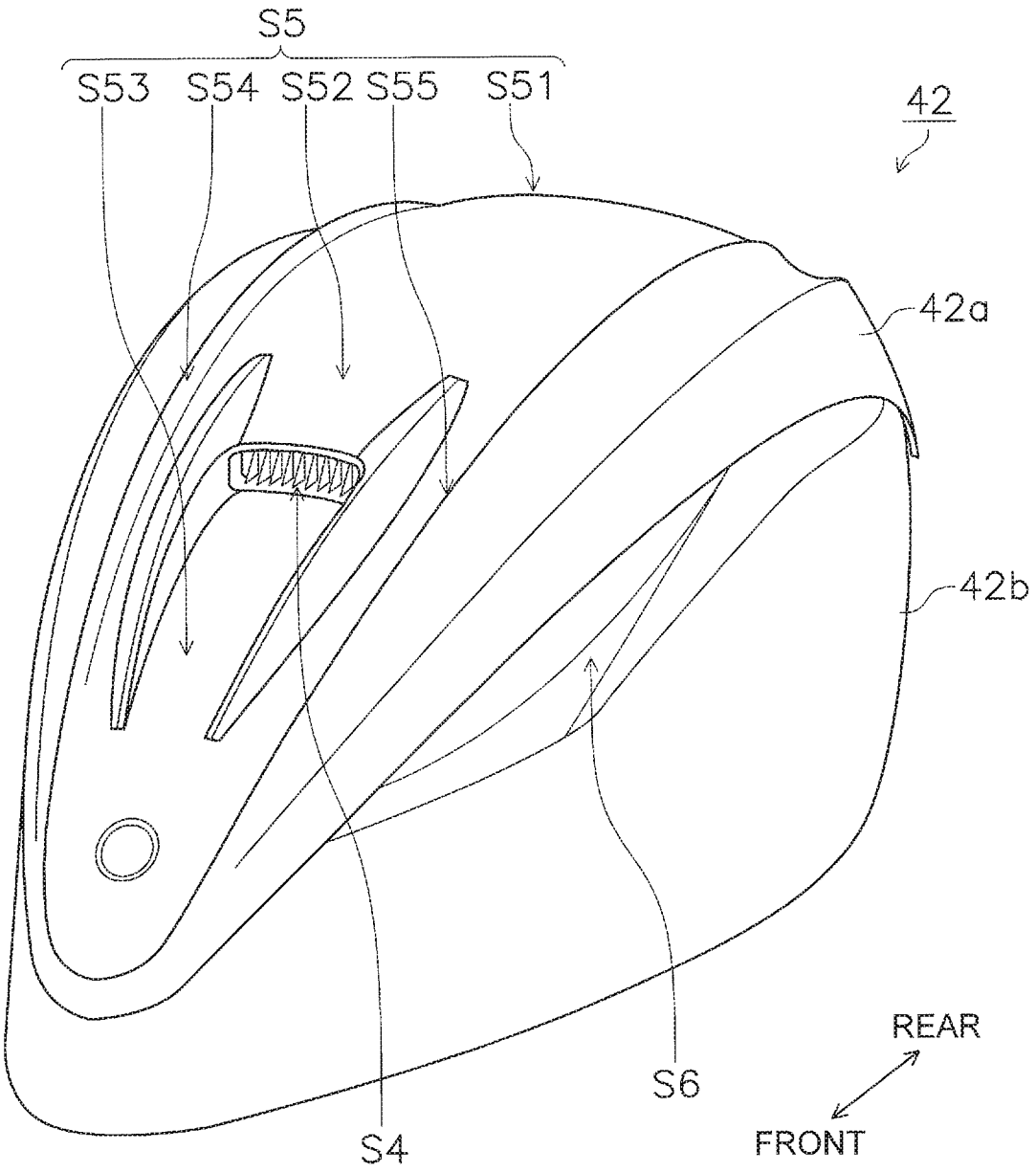
FIG. 2 is a perspective view of the appearance of a top cowl.
Figure 3:
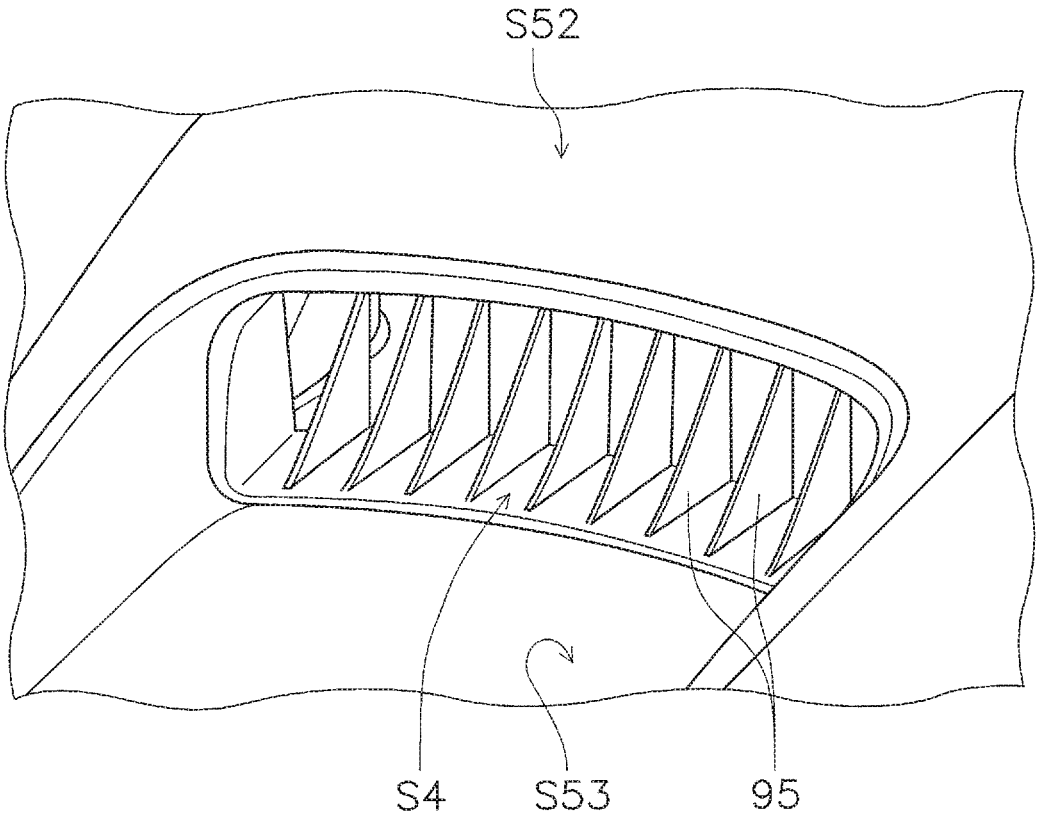
FIG. 3 is a partial enlarged view of FIG. 2.

FIG. 1 is a side view of a watercraft 1. FIG. 2 is a perspective view of the appearance of a top cowl 42. FIG. 3 is a partial enlarged view of FIG. 2.

The watercraft 1 includes an outboard motor 100 and a vessel body 200.

The outboard motor 100 is a propulsion device for the vessel body 200. The outboard motor 100 is attached to the stern of the vessel body 200.

The outboard motor 100 includes an engine 10, a flywheel magnet electric power generator 20, a fan 30, a cowl 40, a drive shaft 50, a shift mechanism 60, a propeller shaft 70, a propeller 80, and a bracket 90.

The engine 10 is preferably an internal combustion engine that burns fuel to generate a driving force. The engine 10 is housed in the cowl 40. The engine 10 includes a crankshaft 12 extending in an up-and-down direction.

The flywheel magnet electric power generator 20 is preferably an alternating electric power generator that functions as an accessory of the engine 10. The flywheel magnet electric power generator 20 includes a flywheel rotor 21 and a stator 22. The flywheel rotor 21 is coupled to an upper end portion of the crankshaft 12, and rotates together with the crankshaft 12.

The fan 30 is preferably disposed directly above the flywheel magnet electric power generator 20. The fan 30 is driven by the engine 10. The fan 30 functions as a ventilator that discharges air inside the cowl 40. The fan 30 includes a vane assembly 31 and a fan cover 32. The vane assembly 31 is coupled to the flywheel rotor 21 of the flywheel magnet electric power generator 20, and rotates together with the flywheel rotor 21. The fan 30 feeds air sucked therein from below to an exhaust pathway S3 to be described below. The fan 30 is preferably disposed directly below the exhaust pathway S3.

The cowl 40 includes an engine compartment S1, an intake pathway S2, the exhaust pathway S3, an exhaust port S4, an upper surface S5, and an intake port S6.

The engine compartment S1 houses the engine 10. The intake pathway S2 directs air drawn in through the intake port S6 to a throttle body 11. The intake pathway S2 is disposed inside the top cowl 42. The intake pathway S2 preferably passes directly below the exhaust pathway S3.

The exhaust pathway S3 directs the exhaust fed thereto from the fan 30 to the exhaust port S4. The exhaust pathway S3 is disposed inside the top cowl 42. The exhaust pathway S3 is preferably disposed directly above the fan 30.

The exhaust port S4 is connected to the exhaust pathway S3. The exhaust port S4 is an opening that discharges the exhaust fed thereto from the exhaust pathway S3 to the outside. In the present preferred embodiment, the exhaust port S4 is disposed in a position overlapping the center of the cowl 40 in a right-and-left direction. The exhaust port S4 preferably has a shape of a horizontally elongated rectangle or substantially horizontally elongated rectangle. The exhaust port S4 is provided in a region slanting downward and forward in the upper surface S5. It should be noted that the position and the shape of the exhaust port S4 are arbitrarily changeable.

The intake port S6 is an opening that draws in air to be used for combustion of the fuel in the engine 10 from the outside. The intake port S6 is preferably located on the lateral surface of the top cowl 42.

As shown in FIGS. 1 and 2, the exhaust port S4 is located on the top cowl 42, and opens forward. Therefore, compared to an outboard motor provided with an exhaust port that opens sideward or rearward, the outboard motor 100 prevents waves, caused by the vessel body 200, from entering therein through the exhaust port S4 during navigation of the watercraft 1. Additionally, the outboard motor 100 also prevents droplets of water in a traveling wind from entering therein through the exhaust port S4 during navigation of the watercraft 1 because the pressure inside the exhaust port S4 is kept higher than the outside pressure by driving the fan 30.

As shown in FIG. 2, the exhaust port S4 is located above the intake port S6. In other words, the intake port S6 is located below the exhaust port S4. Therefore, the outboard motor 100 prevents relatively high-temperature exhaust discharged through the exhaust port S4 from being drawn therein through the intake port S6.

As shown in FIG. 3, there are, for example, nine ribs 95 disposed in the exhaust port S4. This configuration prevents a worker from unintentionally inserting his/her finger into the exhaust port S4 that has been heated by the exhaust. The nine ribs 95 are disposed inside the exhaust port S4. The nine ribs 95 are disposed in a raised position at intervals in the right-and-left direction. Each of the intervals among the nine ribs 95 is preferably set to have a width narrow enough to prevent insertion of a finger of the worker. Each rib 95 preferably has a shape of a triangular plate or substantially triangular plate. It should be noted that the shape and the number of the ribs 95 are arbitrarily changeable.

The cowl 40 includes a bottom cowl 41 and the top cowl 42. The bottom cowl 41 surrounds the engine 10 from below and the lateral sides. The bottom cowl 41 opens upward. The top cowl 42 covers the engine 10 from above and the lateral sides. The top cowl 42 is disposed on the bottom cowl 41. The top cowl 42 opens downward, and closes the opening of the bottom cowl 41. The top cowl 42 is detachably coupled to the bottom cowl 41.

As shown in FIG. 2, the top cowl 42 includes an upper cover 42*a* and a lower cover 42*b*. The upper cover 42*a* is disposed on the lower cover 42*b*. The upper cover 42*a* is preferably entirely curved and has the shape of a lid. The intake port S6, which opens sideward, is located between the upper cover 42*a* and the lower cover 42*b*.

As shown in FIG. 2, the upper surface S5 of the upper cover 42*a* includes a top surface S51, a first forwardly slanted surface S52, a second forwardly slanted surface S53, a right slanted surface S54, and a left slanted surface S55. The top surface S51 is in a region located the highest among the regions of the upper surface S5. The first forwardly slanted surface S52 extends forward and downward from the top surface S51. The first forwardly slanted surface S52 extends to the top surface S51 and the upper end of the exhaust port S4. The second forwardly slanted surface S53 extends forward and downward from the lower end of the exhaust port S4. The first and second forwardly slanted surfaces S52 and S53 are located in the middle of the upper surface S5 in the right-and-left direction. The right slanted surface S54 is located on the right side of the first and second forwardly slanted surfaces S52 and S53. The right slanted surface S54 extends forward and downward from the top surface S51. The left slanted surface S55 is located on the left side of the first and second forwardly slanted surfaces S52 and S53. The left slanted surface S55 extends forward and downward from the top surface S51.

The drive shaft 50 is coupled to a lower end portion of the crankshaft 12, and is rotated by the driving force of the engine 10. The shift mechanism 60 switches the rotation of the propeller shaft 70 among a forward moving state, a neutral state, and a backward moving state. The propeller 80 is attached to a rear end portion of the propeller shaft 70. The bracket 90 couples the outboard motor 100 to the vessel body 200. The bracket 90 supports the outboard motor 100 such that the outboard motor 100 is pivotable back and forth and right and left.

Figure 4:
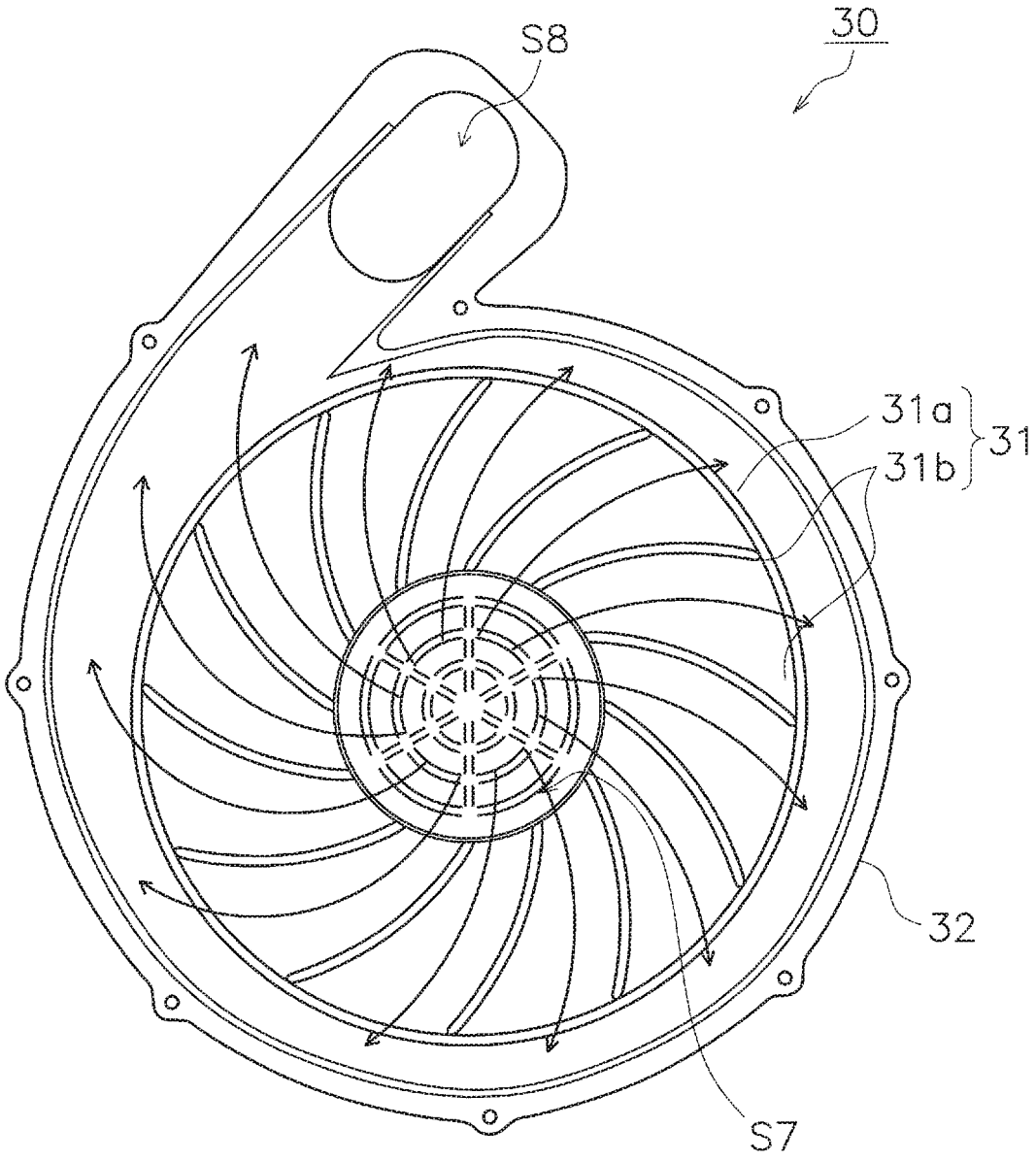
FIG. 4 is a top transparent view of a fan.

FIG. 4 is a top transparent view of the configuration of the fan 30.

The fan 30 includes the vane assembly 31 and the fan cover 32.

The vane assembly 31 is housed in the fan cover 32. The vane assembly 31 includes an annular disc 31*a* and a plurality of fins 31*b*. The annular disc 31*a* preferably has the shape of a ring. The annular disc 31*a* is coupled to the flywheel rotor 21 (see FIG. 1) of the flywheel magnet electric power generator 20. The plural fins 31*b* are disposed on the annular disc 31*a*. The plural fins 31*b* are disposed in a raised position at intervals from each other. Each fin 31*b* preferably has the shape of a curved plate. It should be noted that the shape and the number of the fins 31*b* are arbitrarily changeable.

The fan cover 32 houses the vane assembly 31. The fan cover 32 includes a suction port S7 and a discharge port S8. The suction port S7 is located on the bottom surface of the fan cover 32. The discharge port S8 is located on the fan cover 32. In the present preferred embodiment, the discharge port S8 opens upward.

When the vane assembly 31 is rotated, air heated by the engine 10 and the flywheel magnet electric power generator 20 is sucked into the fan cover 32 through the suction port S7. The air sucked into the fan cover 32 is discharged to the exhaust pathway S3 (see FIG. 1) through the discharge port S8.

The structure of a louver assembly 110 in the exhaust pathway S3 will be explained with reference to the drawings. The louver assembly 110 is located between the upper cover 42*a* and the lower cover 42*b* of the top cowl 42 shown in FIG. 2.

Figure 5:
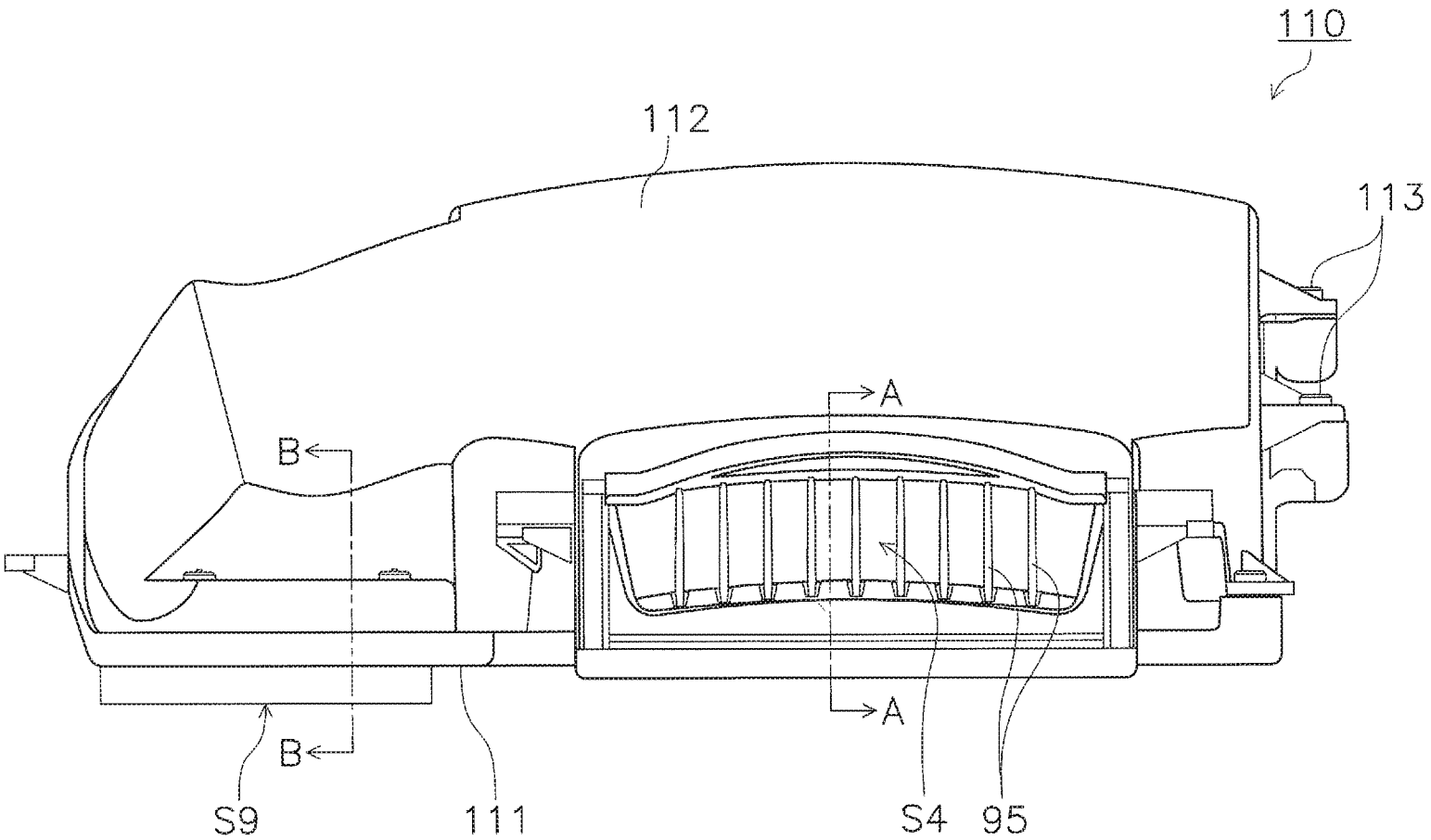
FIG. 5 is a front view of a louver assembly.
Figure 6:
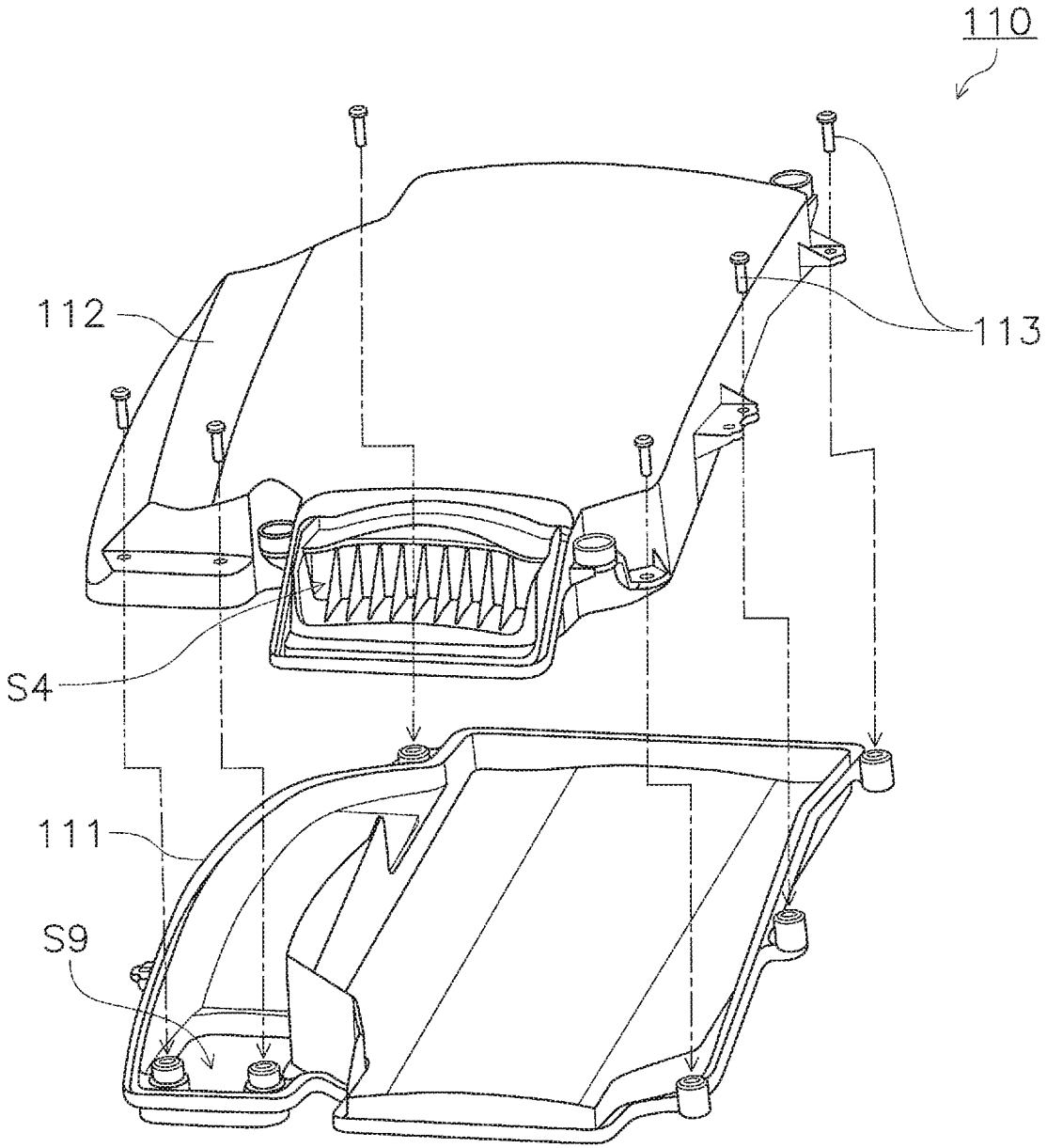
FIG. 6 is an exploded perspective view of the louver assembly.
Figure 7:
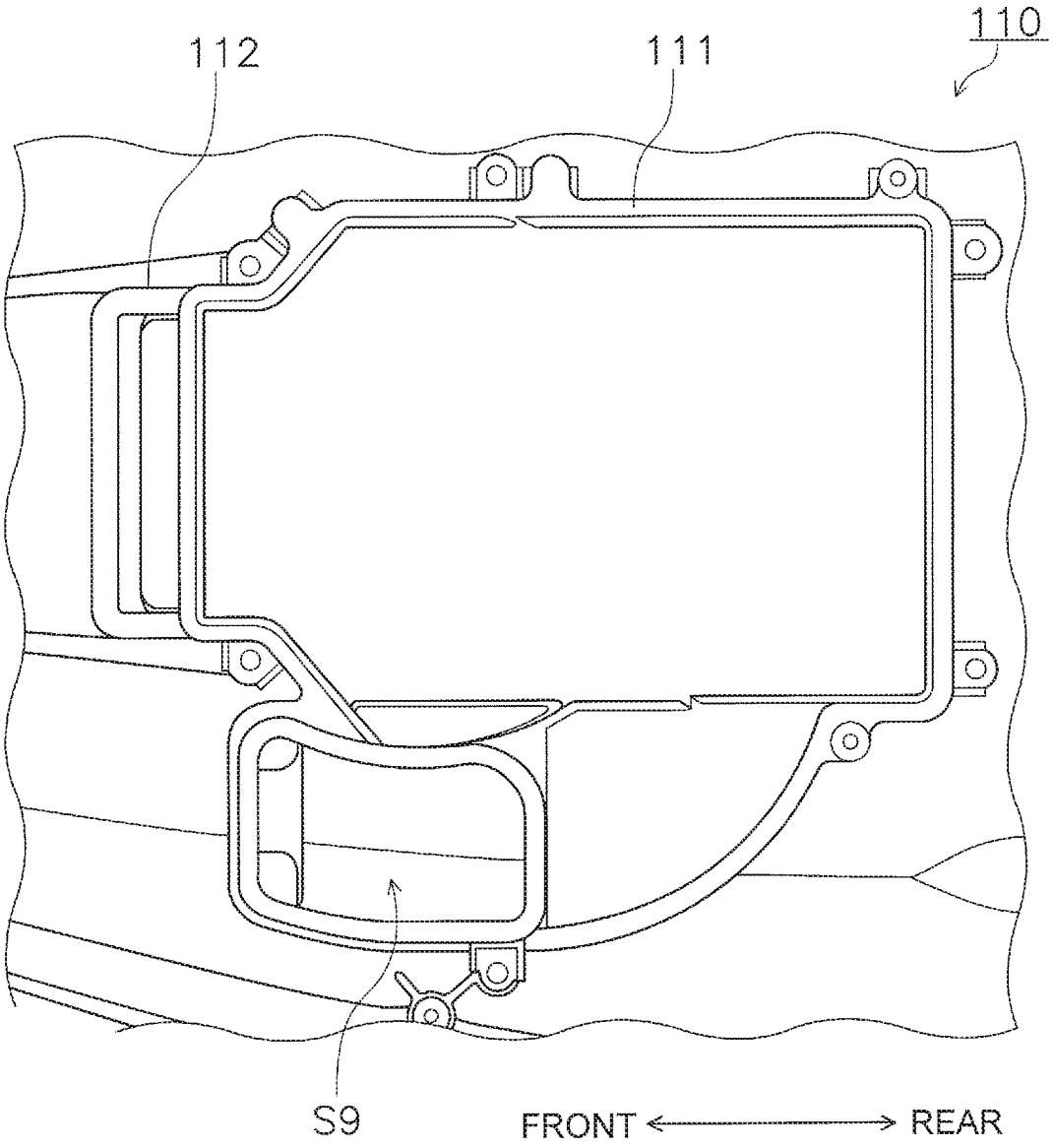
FIG. 7 is a bottom view of the louver assembly.

FIG. 5 is a front view of the louver assembly 110. FIG. 6 is an exploded perspective view of the louver assembly 110. FIG. 7 is a bottom view of the louver assembly 110.

The louver assembly 110 is, for example, a box that the exhaust pathway S3 is provided in the interior thereof. The louver assembly 110 includes a first louver 111 and a second louver 112.

The first louver 111 opens upward. The first louver 111 includes a drawing port S9 on the bottom surface thereof. The drawing port S9 is coupled to the discharge port S8 (see FIG. 4) of the fan 30.

The second louver 112 is disposed on the first louver 111. The second louver 112 opens downward. The second louver 112 closes the opening of the first louver 111. The second louver 112 is fixed to the first louver 111 by a plurality of screws 113, for example.

Figure 8:
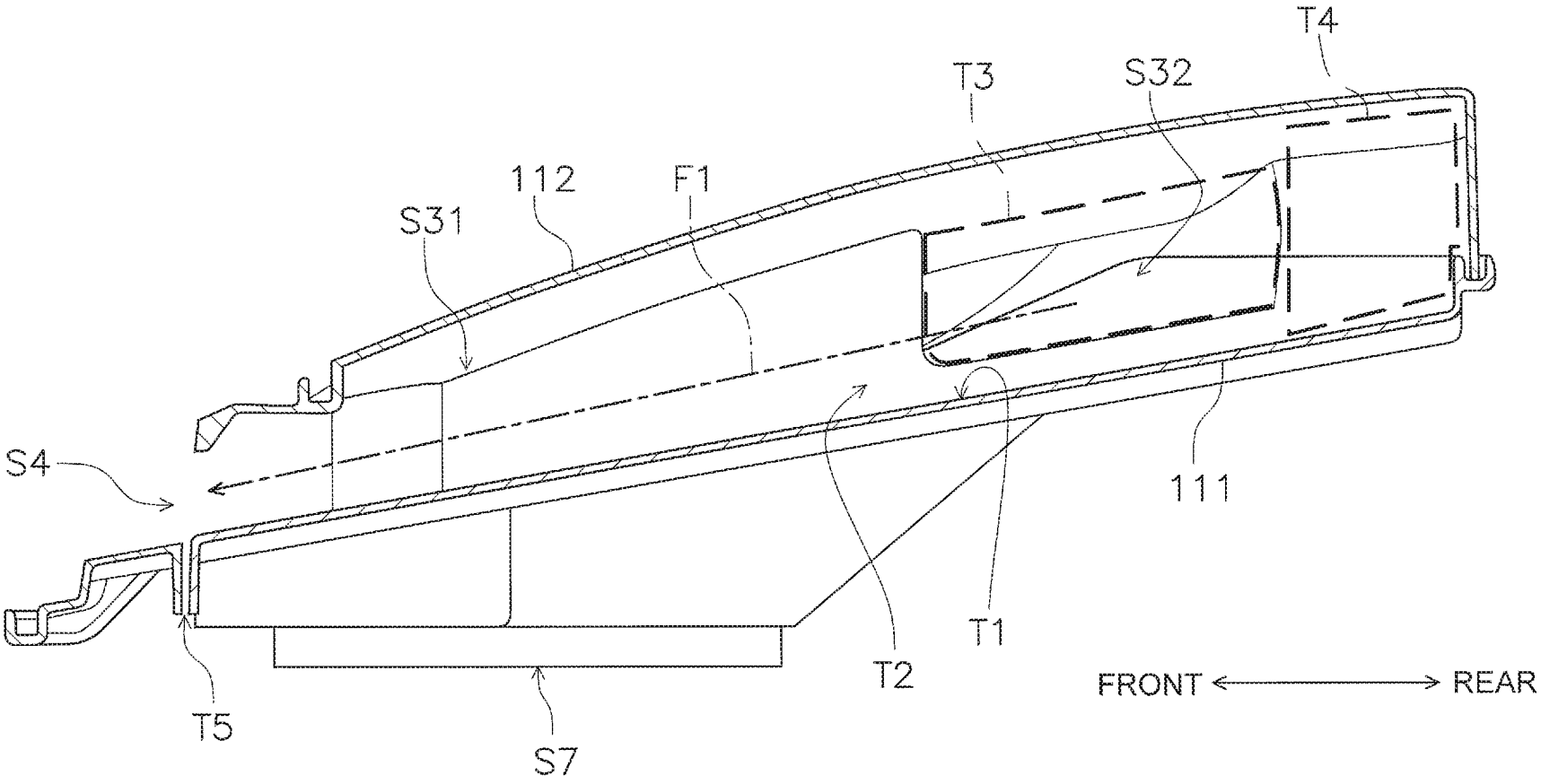
FIG. 8 is a cross-sectional view of FIG. 5 taken along line A-A.
Figure 9:
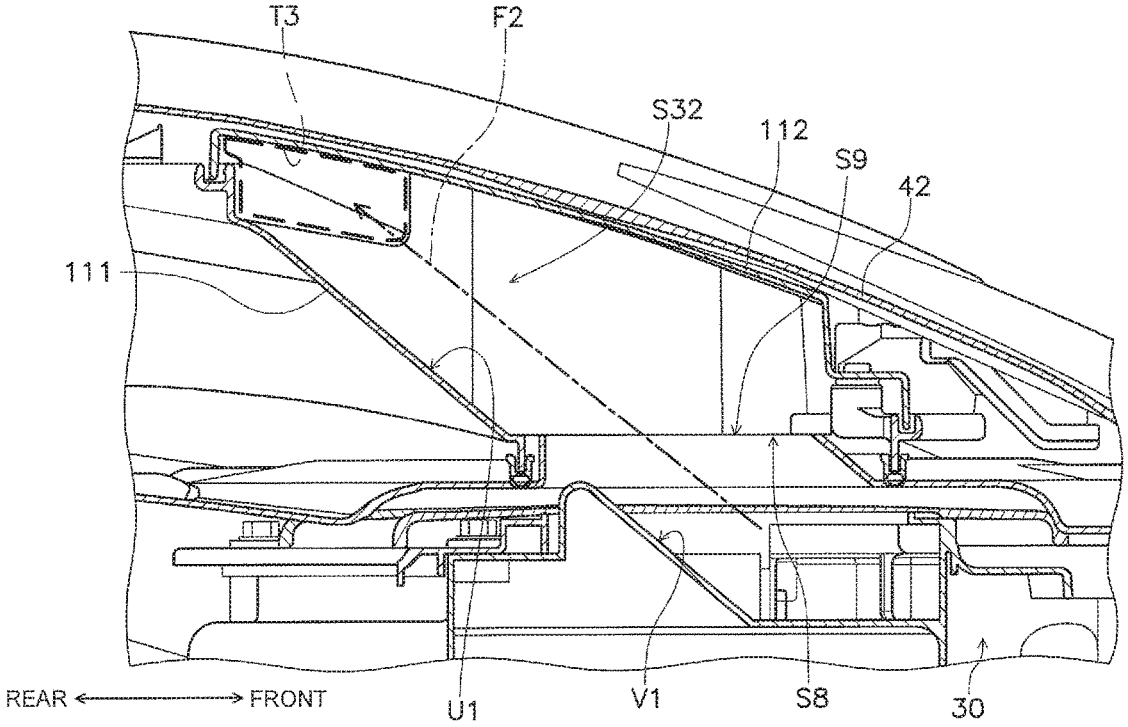
FIG. 9 is a cross-sectional view of FIG. 5 taken along line B-B.

The upper surface of the second louver 112 opposes the inner surface of the upper cover 42*a* of the top cowl 42 (not shown in FIGS. 5 to 8; see FIG. 9). The upper surface of the second louver 112 is separated from the inner surface of the upper cover 42*a*. With this structure, a heat insulating space is provided between the upper surface of the second louver 112 and the inner surface of the upper cover 42*a*, such that it is possible to prevent a situation that the upper cover 42*a* is heated by the heat of the exhaust flowing through the interior of the louver assembly 110. The interval between the upper surface of the second louver 112 and the inner surface of the upper cover 42*a* is arbitrarily changeable.

FIG. 8 is a cross-sectional view of FIG. 5 taken along line A-A. FIG. 9 is a cross-sectional view of FIG. 5 taken along line B-B. FIG. 9 shows not only the louver assembly 110 but also the fan 30 in a cross-sectional representation.

The internal space of the louver assembly 110 defines a portion of the exhaust pathway S3.

The exhaust pathway S3 includes an exhaust compartment S31 and a communication pathway S32. The exhaust compartment S31 is provided inside the exhaust port S4. The communication pathway S32 communicates with the exhaust compartment S31 and the discharge port S8 of the fan 30.

The exhaust compartment S31 is a space in which exhaust flows forwardly therein from the communication pathway S32. The exhaust compartment S31 extends from the communication pathway S32 toward the exhaust port S4. The exhaust compartment S31 is preferably entirely shaped to slant downward and forward. In other words, the exhaust compartment S31 is shaped such that the rear end portion thereof, extending to the communication pathway S32, is located above the front end portion thereof which includes the exhaust port S4. During navigation of the watercraft 1, the pressure in the interior of the communication pathway S32 is kept higher than the outside pressure by driving the fan 30. Hence, water, even if entering the exhaust compartment S31 through the exhaust port S4, is prevented from entering the communication pathway S32 from the exhaust compartment S31.

The exhaust compartment S31 includes a bottom surface T1, an inner lateral surface T2, an interior opening T3, and a buffer space T4.

The bottom surface T1 entirely slants upward and rearward. Therefore, water, even if entering the exhaust compartment S31 through the exhaust port S4, is prevented from flowing toward the communication pathway S32. Additionally, a drainage groove T5 is provided on the front end of the bottom surface T1. The drainage groove T5 opens downward. Therefore, water, even if entering the exhaust compartment S31 through the exhaust port S4, is quickly drained through the drainage groove T5.

The inner lateral surface T2 extends to the bottom surface T1, and is raised with respect to the bottom surface T1. The interior opening T3 is provided on the inner lateral surface T2. The interior opening T3 extends to the communication pathway S32. The lower end of the interior opening T3 is located above the upper end of the exhaust port S4. Therefore, water, even if entering the exhaust compartment S31 through the exhaust port S4, is more reliably prevented from entering the communication pathway S32 through the interior opening T3. The shape of the interior opening T3 is arbitrarily changeable.

The buffer space T4 is provided rearward of the interior opening T3. Therefore, water, even if reaching the interior opening T3 after entering the exhaust compartment S31 through the exhaust port S4, is deflected to the buffer space T4, such that the water is more reliably prevented from entering the communication pathway S32 through the interior opening T3. Limitations are not particularly imposed on the shape and the size of the buffer space T4.

The communication pathway S32 is a space in which the exhaust flows rearwardly and obliquely upwardly from the fan 30. The communication pathway S32 extends from the drawing port S9 toward the interior opening T3. The communication pathway S32 is preferably entirely shaped to slant upward and rearward. In other words, the communication pathway S32 is shaped such that the rear end portion thereof, extending to the interior opening T3, is located above the front end portion thereof that includes the drawing port S9.

As is seen in FIG. 6, the communication pathway S32 extends rearward and upward in a curved shape. Therefore, the rearward flow of the exhaust in the communication pathway S32 smoothly veers toward the forward flow of the exhaust in the exhaust compartment S31. Hence, the pressure loss of the exhaust is reduced.

The communication pathway S32 includes a bottom surface U1. The bottom surface U1 of the communication pathway S32 preferably has a shape corresponding to a shape of the bottom surface V1 of the fan cover 32 of the fan 30. Specifically, the bottom surface V1 of the fan cover 32 slants upward and rearward. Hence, the bottom surface U1 of the communication pathway S32 also slants upward and rearward. The slant angle of the bottom surface U1 of the communication pathway S32 is equal or approximately equal to that of the bottom surface V1 of the fan cover 32. Additionally, the bottom surface U1 of the communication pathway S32 is located on an imaginary plane on which the bottom surface V1 of the fan cover 32 of the fan 30 is located. Therefore, it is possible to smoothly flow the exhaust from the fan 30 to the communication pathway S32 to enhance the efficient flow of the exhaust.

The exhaust compartment S31 is wider than the communication pathway S32. Specifically, the cross-sectional area of the exhaust compartment S31 in a direction perpendicular to a flow-through direction F1 of the exhaust flowing in the exhaust compartment S31 is larger than that of the communication pathway S32 in a direction perpendicular to a flow-through direction F2 of the exhaust flowing in the communication pathway S32. Thus, the pressure loss of the exhaust is reduced by providing a wide space ahead of the communication pathway S32.

The exhaust port S4 is narrower than the exhaust compartment S31. Specifically, the opening area of the exhaust port S4 is smaller than the cross-sectional area of the exhaust compartment S31 in the direction perpendicular to the flow-through direction F1 of the exhaust flowing in the exhaust compartment S31. Therefore, even when the exhaust compartment S31, which is a relatively wide space, is provided to reduce the pressure loss of the exhaust, water is prevented from entering the exhaust compartment 31 through the exhaust port S4.

Preferred embodiments of the present invention have been explained above. However, the present invention is not limited to the above-described preferred embodiments, and a variety of changes can be made without departing from the gist of the present invention.

In the above-described preferred embodiments, as shown in FIG. 2, the exhaust port S4 is located between the first forwardly slanted surface S52 and the second forwardly slanted surface S53. However, the location of the exhaust port S4 is not limited to this, as long as the exhaust port S4 opens forward. For example, the exhaust port S4 may be located on a step portion between a first horizontal surface and another horizontal surface located below the first horizontal surface.

In the above-described preferred embodiments, as shown in FIG. 1, the exhaust port S4 is approximately perpendicular to the back-and-forth direction. However, the shape of the exhaust port S4 is not limited to this, as long as the exhaust port S4 opens forward. For example, the exhaust port S4 may slant downward and forward at an angle within a range of about 45 degrees, for example, with respect to the back-and-forth direction.

In the above-described preferred embodiments, as shown in FIG. 1, the exhaust port S4 is parallel or approximately parallel to the up-and-down direction. However, the shape of the exhaust port S4 is not limited to this, as long as the exhaust port S4 opens forward. For example, the exhaust port S4 may slant at an angle within a range of about ±45 degrees, for example, with respect to the up-and-down direction.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:
an engine;
a fan driven by the engine to discharge air surrounding the engine; and
a cowl housing the engine and the fan; wherein
the cowl includes:
a top cowl disposed above the engine and including an exhaust pathway for exhaust to flow from the fan; and
an exhaust port connected to the exhaust pathway and located on the top cowl; and
the exhaust port opens primarily in a forward direction of the outboard motor.

2. The outboard motor according to claim 1, wherein the cowl further includes:
an intake port; and
an intake pathway connected to the intake port and the engine; wherein
the intake port is located below the exhaust port.

3. The outboard motor according to claim 2, wherein the cowl further includes:
a bottom cowl disposed below the top cowl; and
the intake port is provided on a lateral surface of the top cowl.

4. The outboard motor according to claim 1, wherein the exhaust pathway includes:
an exhaust compartment inside the exhaust port; and
a communication pathway communicating with the fan and the exhaust compartment; and
a cross-sectional area of the exhaust compartment in a direction perpendicular to a flow-through direction of the exhaust is larger than a cross-sectional area of the communication pathway in the direction perpendicular to the flow-through direction.

5. The outboard motor according to claim 4, wherein an opening area of the exhaust port is smaller than the cross-sectional area of the exhaust compartment.

6. The outboard motor according to claim 4, wherein the exhaust compartment includes a bottom surface slanting downward and forward.

7. The outboard motor according to claim 4, wherein the exhaust compartment includes:
an inner lateral surface; and
an interior opening on the inner lateral surface, the interior opening connected to the communication pathway; and
a lower end of the interior opening is located above an upper end of the exhaust port.

8. The outboard motor according to claim 7, wherein the exhaust compartment includes a buffer space located rearward of the interior opening.

9. The outboard motor according to claim 4, wherein the fan is disposed below the exhaust compartment; and
the communication pathway extends rearward and upward from the fan and has a curved shape.

10. The outboard motor according to claim 4, wherein the exhaust compartment and the communication pathway are located between a first louver and a second louver disposed on the first louver; and
a heat insulating space is located between an upper surface of the second louver and an inner surface of the top cowl.

11. The outboard motor according to claim 1, wherein the cowl includes a plurality of ribs disposed in the exhaust port.

12. An outboard motor comprising:
an engine;
a fan driven by the engine to discharge air surrounding the engine; and
a cowl housing the engine and the fan; wherein
the cowl includes:
a top cowl disposed above the engine and including an exhaust pathway for exhaust to flow from the fan; and
an exhaust port connected to the exhaust pathway and located on the top cowl; and
the exhaust port is disposed forward of the exhaust pathway.

* * * * *